US006655105B2

(12) United States Patent
Swenson

(10) Patent No.: US 6,655,105 B2
(45) Date of Patent: Dec. 2, 2003

(54) WELDLESS STIRRUP SPACER

(76) Inventor: Richard A. Swenson, 760 Norman Dr., Ridgewood, NJ (US) 07450

( * ) Notice: Subject to any disclaimer, the term of this patent is extended or adjusted under 35 U.S.C. 154(b) by 0 days.

(21) Appl. No.: 09/922,387

(22) Filed: Aug. 3, 2001

(65) Prior Publication Data

US 2003/0024204 A1 Feb. 6, 2003

(51) Int. Cl.[7] ..... E04C 5/16

(52) U.S. Cl. ..... 52/677; 52/684; 52/712; 52/719; 403/391

(58) Field of Search ..... 52/712, 719, 665, 52/666, 677; 403/392, 389, 400, 391

(56) References Cited

U.S. PATENT DOCUMENTS

| | | | |
|---|---|---|---|
| 3,440,792 | A | 4/1969 | Schmidgall |
| 4,939,883 | A | 7/1990 | Swenson |
| 4,999,965 | A | 3/1991 | Schmidgall et al. |
| 5,832,690 | A | 11/1998 | Kaines |
| 5,896,722 | A | 4/1999 | Swenson |

OTHER PUBLICATIONS

Copy of Brochure by Hawkeye Group, "Spacers and Reinforcement Accessories for Concrete Products", pp. 6–8.

*Primary Examiner*—Carl D. Friedman
*Assistant Examiner*—Yvonne M. Horton

(57) ABSTRACT

A weldless stirrup spacer for manual installation, without a tool, on the concentric or parallel inner and outer reinforcement wire cages of reinforced concrete pipe or other concrete structures so as to position and maintain the cages at the required spaced-apart location. The spacer is formed as a unitary resilient wire member having a pigtail-shaped hook end at one end of a central spanning portion and a fastening end portion at the other end of the spanning portion. When installed, the pigtail-shaped hook end encircles a main reinforcement wire of the inner reinforcement cage, and the fastening end portion resiliently captures an opposed main reinforcement wire of the outer reinforcement cage. The fastening end portion includes a rounded loop portion which extends beyond the outer cage to contact the adjacent mold wall and space the outer reinforcement cage at the appropriate concrete-cover distance from the mold surface. The rounded loop portion also functions as a handgrip for the tool-less hand installation of the weldless stirrup spacer on the reinforcement wires.

11 Claims, 3 Drawing Sheets

WELDLESS STIRRUP SPACER

FIELD OF THE INVENTION

The present invention relates generally to reinforcement spacers for reinforced concrete structures and, more particularly, to a weldless stirrup spacer for connecting and positioning concentric or parallel reinforcement wire cages in such structures.

BACKGROUND OF THE INVENTION

Stirrup spacers are conventionally used in double cage reinforced round concrete pipe to position the inner and outer reinforcement cages at the appropriate distance apart and to space the outer reinforcement cage from the outer form surface to provide the required concrete cover. Such spacers typically take the form of a resilient wire member that hooks or snaps over the reinforcement wires. When the stirrup spacers are installed, the inherent resiliency of the outer reinforcement cage tends to apply tensile forces to the spacers to hold them in place. Such tensile forces, however, are not always evenly sufficient to maintain the proper placement of the spacers on the cages in the face of strong dislodging forces during casting. Moreover, conventional stirrup spacers do not prevent displacement of the inner and/or outer reinforcement cages towards one another.

To overcome these problems with conventional stirrup spacers, the spacers are generally tied or welded to the reinforcement wires. Not only are these labor-intensive, time consuming processes, they do not fully solve the problems. In the case of tying, tie wires are relatively weak and can fail and allow displacement of the cages towards each other during pouring of the concrete. Welding, on the other hand, can weaken the reinforcement wires of the cages and/or the spacers, and welding is often not permitted by the product specifications for that reason. Also, in applications where galvanized (zinc coated) reinforcement wires are required, welding volatilizes the zinc and the vapors present a serious toxic health hazard to workers, which is prohibitive.

In addition, certain prior art stirrup spacers are difficult to install on the reinforcement cages, requiring the use of an installation tool and both of the worker's hands. Such tool-installed spacers are not only difficult and time-consuming to handle, but they can cause injury to the worker in the event the tool slips out of position during installation.

SUMMARY OF THE INVENTION

An object of the present invention is to provide a weldless stirrup spacer that can be safely installed manually—i.e., by hand without any tools—and which requires very little force to be applied to it when it is being installed.

Another object is to reduce the costs of producing concrete structures, and precast concrete structures in particular, by eliminating welding or tie-wiring the stirrup spacers to the reinforcement wires and by providing weldless stirrup spacers that are relatively inexpensive and that can be quickly installed, thus saving time and labor costs when the wire reinforcement cages are being assembled within the molds.

It is also an object to provide a weldless stirrup spacer that remains securely in position after installation and especially when the concrete is being poured into the mold.

Still another object is to provide a weldless stirrup spacer that can be manufactured at low cost in one machine operation.

The foregoing and other objects are attained, in accordance with the invention, by the provision of a weldless stirrup spacer which is formed as a unitary resilient wire member having a hook end pigtail portion for engagement with a first reinforcement wire (for example, of an inner reinforcement cage), an elongated spanning portion having an axis of elongation B—B, and a fastening end for engagement with a second reinforcement wire (for example, of an outer reinforcement cage). The hook end includes a generally corkscrew-shaped pigtail portion extending from a juncture with the spanning portion laterally to one side of the spanning portion along an axis of curvature A—A that is substantially perpendicular to the axis B—B. As installed on the first reinforcement wire, the pigtail portion engages upwardly, outwardly, downwardly and inwardly facing surfaces of the first reinforcement wire at spaced distances along the axis of curvature A—A. In a preferred embodiment, the pigtail portion includes a curved body portion which lies substantially in a plane C—C that is inclined at an acute angle to the axis B—B. The pigtail portion preferably terminates in an upright end portion which extends out of the plane C—C in the direction away from the central spanning portion. The upright end portion engages inwardly and upwardly facing surfaces of the reinforcement wire.

The fastening end portion includes a detent part which is curved to form a groove at a juncture with the other end of the spanning portion so as, when installed, to engage upwardly, outwardly and downwardly facing surfaces of the second reinforcement wire at a first location along the reinforcement wire, a J-hook part shaped and positioned to form a groove so as to engage upwardly, inwardly and downwardly facing surfaces of the second reinforcement wire at a second location along the reinforcement wire spaced laterally apart from the first location to the same side of the spanning portion as the spiral-shaped main portion of the hook end, and a loop part joining the detent part and the J-hook part. The loop part of the fastening end serves the dual function of spacing the second reinforcement wire at the correct concrete-cover distance from the adjacent mold wall and providing a handgrip to be grasped and hand pushed by a worker during installation of the spacer on the reinforcement wires.

The foregoing configuration of the weldless stirrup spacer affords a number of important advantages relative to prior art stirrup spacers.

The pigtail-shaped hook end provides a unique four-way holding engagement with the first reinforcement wire, thereby restraining the wire against movement in all four principal directions, i.e., upwardly, downwardly, inwardly or outwardly.

The fastening end portion of the spacer locks downwardly onto the second reinforcement wire and, in combination with the hook end portion, secures the first and second reinforcement wires (for example, the inner and outer reinforcement cages) together into a single, strong and positive reinforcement unit.

The spacer can readily be installed on both wires with one hand, without tools and without tying or welding. This capability greatly facilitates installation of the spacer through the outer reinforcement wire cage of reinforced concrete structures such as reinforced concrete pipe.

The tool-less one-handed installation of the spacer avoids the risk of injury associated with the installation of certain prior art spacers because the present invention does not require torsional or twisting forces to fasten it to the reinforcement wires.

As the stirrup spacer of the invention is a single, unitary wire member, it can be economically manufactured, in one machine operation.

The weldless stirrup spacer of the invention thus combines in a single, unitary member ease and safety of attachment, economy of manufacture, and strength and accuracy of installation.

In preferred embodiments, the plane C—C of the curved main body portion of the hook end is inclined at an acute angle of approximately 60°±5° to the axis of elongation of the spanning portion of the spacer. The upright end portion of the pigtail preferably lies in a plane D—D that is inclined at an angle of 60°±5° to the axis of curvature A—A of the pigtail portion. Also, the upright end portion preferably terminates at the same elevation as the spanning portion.

The J-hook part of the fastening end portion preferably includes a serpentine distal end leg part, the tip of which forms a camming surface that is adapted to engage an inner surface of the second reinforcement wire and facilitate reception of the second reinforcement wire into the groove of the J-hook part by aiding in causing lateral deflection of the spacer's fastening end and resilient constriction of the spacer hook portion of the fastening end. The J-hook part and detent part of the fastening end portion form in profile a throat having an entrance that is narrower than the lateral thickness of the second reinforcement wire. The loop part of the fastening end is preferably substantially arcuate in profile, and the outer extremity of the loop part is adapted to engage one form of a mold for a reinforced concrete structure to position the second reinforcement wire in a predetermined position within the mold.

BRIEF DESCRIPTION OF THE DRAWINGS

For a more complete understanding of the invention, and of the features and advantages thereof, reference may be made to the following description of an exemplary embodiment, taken in conjunction with the accompanying drawings, in which.

DESCRIPTION OF AN EXEMPLARY EMBODIMENT

Although the spacer of the invention has particular application in the securement and placement of concentric wire reinforcement cages in precast concrete structures, and round reinforced concrete pipe in particular, it also has utility in concrete structures that are reinforced with steel reinforcement bars, known as re-bars, which are typically thicker than wire. Unless otherwise stated, therefore, the terms "wire reinforcement", "reinforcement wire", etc., as used herein, whether or not in reference to cages, are intended to encompass both wire and re-bars. The invention also has application in spacing any parallel wire reinforcement meshes or wires.

Throughout the present specification and the appended claims, the terms "outwardly" and "inwardly" are used with reference to the center of the space between two reinforcing wire cages being joined by the spacer. The terms "upwardly", "downwardly" and "laterally" are used, as a matter of convenience, to identify relationships among elements.

Figure 1:
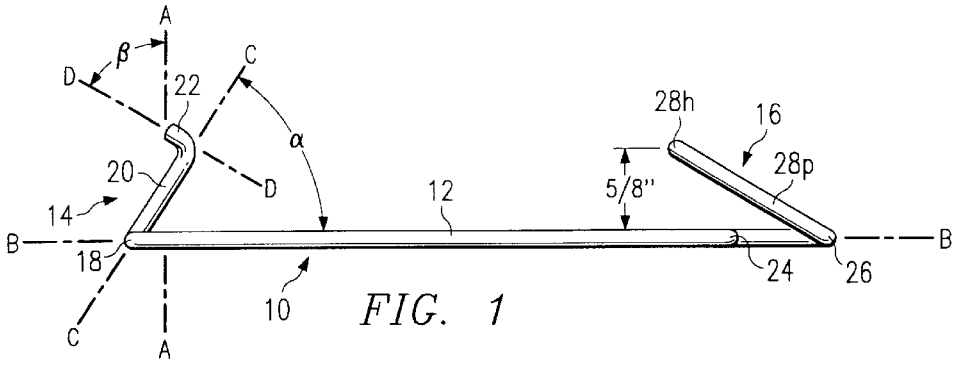
FIG. 1 is a top plan view of one embodiment of a weldless stirrup spacer in accordance with the invention.
Figure 2:
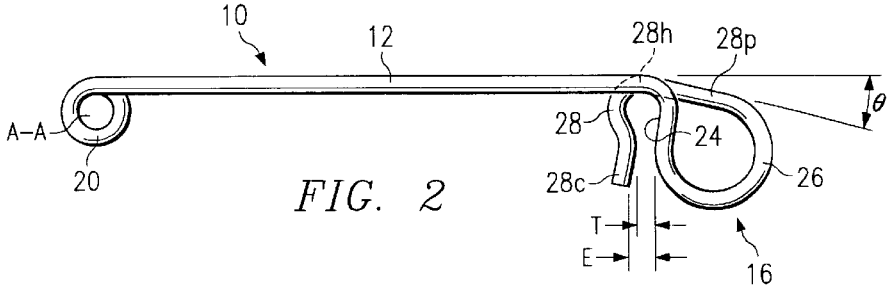
FIG. 2 is a front elevational view of the embodiment of FIG. 1.
Figure 4:
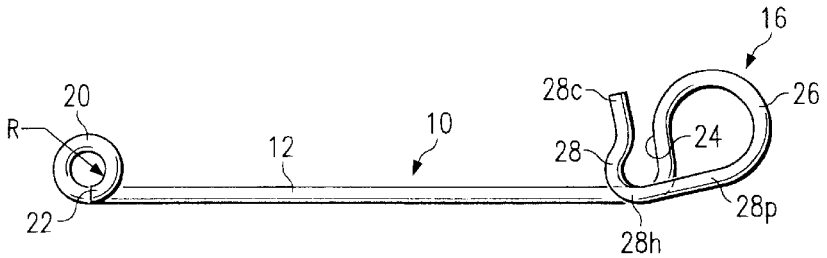
FIG. 4 is a rear elevational view of the embodiment of FIG. 1.

In the exemplary embodiment shown in the drawings, the spacer is a length of a spring steel wire 10 of No. 6 gage (0.192 inch diameter), but more or less as required, that is bent at each end to form at one end of a straight spanning portion 12 a pigtail hook end portion 14 and at the other end of the spanning portion 12 a fastening end portion 16. The hook end portion 14 originates at a juncture 18 with the spanning portion 12 and is formed along an axis of curvature, or spiral, A—A that extends laterally to the side of the spanning portion 12 at an angle of approximately ninety degrees to the plane normal to FIG. 1 and containing the axis B—B of the spanning portion 12. The hook end 14 preferably has a generally corkscrew-shaped pigtail configuration, including a main body portion 20 which lies in a plane C—C at an acute angle $\alpha$ to the axis B—B. The pigtail portion terminates in an upright end portion 22 which extends along a plane D—D that preferably extends at an acute angle $\beta$ to axis of curvature A—A of the pigtail portion. The end portion 22 is preferably at the same elevation as the spanning portion 12 (see FIGS. 2 and 4) and preferably terminates substantially at the plane perpendicular to the axis B—B and containing the axis A—A.

Figure 5B:
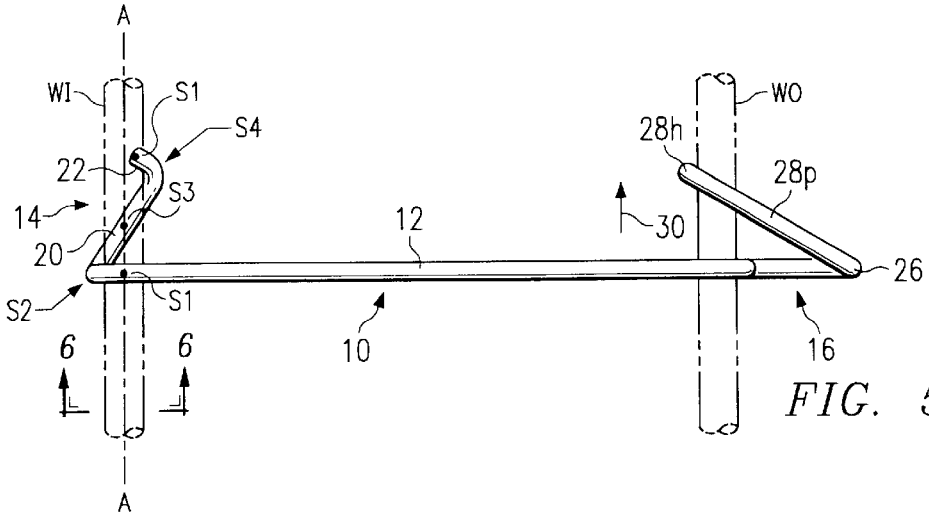
Figure 6:
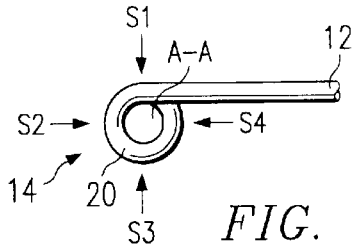
FIG. 6 is a partial cross section view of the pigtail hook end portion taken along the lines 6—6 in FIG. 5B.

The foregoing pigtail configuration of the hook end portion 14 provides a unique four-way holding engagement with the reinforcement wire to which it is attached. This may be best seen in FIGS. 5B and 6, which shows the hook end 14 portion attached to a circumferential reinforcement wire WI of an inner wire cage. The wire WI is held by reactive forces S1, S2, S3 and S4 exerted by the pigtail-shaped hook end portion 14 against movement in four directions, i.e., upwardly, outwardly, downwardly and inwardly, respectively, as indicated by the arrows. As shown in FIGS. 5B and 6, the reactive forces S1, S2, S3 and S4 act on the wire WI at all four principal directions about the circumference of the pigtail portion 14 and at laterally spaced distances along the length of the pigtail portion in the direction of the axis A—A. This provides a stable, permanent engagement of the hook end portion 14 with the reinforcement wire WI which, together with the engagement of the fastening end portion 16 with the outer cage reinforcement wire WO as described below, secures the two cages into a single positive concentric or parallel reinforcement unit.

Figure 3:
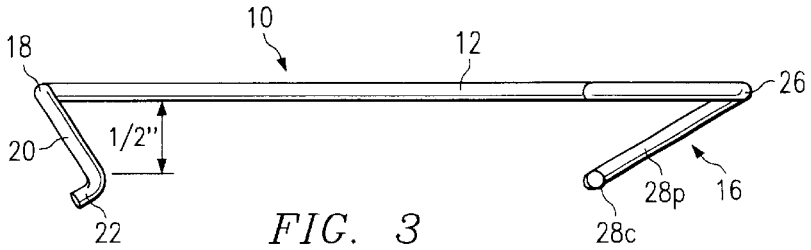
FIG. 3 is a bottom plan view of the embodiment of FIG. 1.

For a spacer made of #6 gauge wire intended for installation on a size 0.250–0.440 inch diameter reinforcement wire, for example, the length of the curved main body portion 20 of the pigtail hook end 14 along the axis A—A may be such as to provide approximately ½ inch clearance between the facing surfaces of the spanning portion 12 and the beginning of the end portion 22. This is indicated in FIG. 3. In such case, the radius of curvature R of the pigtail body portion 20 (see FIG. 4) may be approximately 7/32 inch and the angle of inclination $\alpha$ away from the spanning portion 12 (see FIG. 1) may preferably be within the range of 60°±5°. The angle $\beta$ may also be on the order of 60°±5°.

It will be understood that the spacer 10 may be sized and shaped for other gages of reinforcement wires and from other gages of spacer wires, and that the aforementioned exemplary dimensions will vary as appropriate to suit the particular application. Also, the spacers may be produced in a range of sizes, e.g., from 1 inch to 12 inches or more in length, to provide for a plurality of desired spacings between the inner and outer reinforcement wires or cages, and in a range of loop sizes to accommodate various concrete covers over the reinforcement cages of wires WI and WO.

The fastening end portion 16 has a detent part 24, a spacer loop part 26, and a J-hook part 28. The spacer loop part 26 is smoothly curved in side elevation (see FIG. 2) and provides a lateral offset (see FIG. 1) with respect to the detent part 24 of the J-hook part 28. The J-hook part 28 has a proximal leg portion 28*p*, a curved hook portion 28*h*, and a distal cam portion 28*c*, the hook portion 28*h* and the cam portion 28*c* being of a serpentine shape in lateral profile (see FIG. 2). The hook portion 28*h* is substantially arcuate, with a radius closely matching that of the reinforcing wire with which the spacer is to be used. For the exemplary #6 gage wire spacer, the lateral offset between the detent part 24 and the spacer loop part 26 is preferably approximately ⅝ inch (see FIG. 1), and the angle θ formed by the proximal leg portion 28*p* with the spanning portion axis B—B is preferably on the order of 30°±5°. In the relaxed state shown in FIG. 2, the width of the throat T between the opposed surfaces of the cam portion 28*c* and the detent part 24 may be approximately ⅛ inch, while the width of the entrance E below throat may be approximately ¼ inch. These dimensions will insure that the fastening end portion 16 will securely lock onto the outer wire WO, assuming an exemplary wire diameter within the range of 0.250–0.440 inches. The spacer loop part 26 is sized to provide the desired spacing between the outer wire WO and the mold wall, e.g., 1 inch as illustrated in FIGS. 5D and 7D, but this spacer loop size may change with various concrete cover requirements.

As noted, the weldless stirrup spacers 10 are used to join the inner reinforcement wire cage and the outer reinforcement wire cage at a predetermined spacing from each other and to position the outer cage at the desired spacing from the outer mold into which the concrete for the pipe section or other precast structure is poured. Generally, the spacers are attached to the cages provided in a grid, each spacer joining a main circumferential wire of the inner cage to a main circumferential wire of the outer cage opposite from the wire of the inner cage. As installed, the spanning portion 12 of each spacer is perpendicular to the outer surface of the wall of the pipe section. The cages are usually assembled around the mold core, with the mold jacket being removed for that purpose.

As is described more fully hereinafter, the fastening end spacer loop part 26 serves the dual function of (1) spacing the outer wire WO at the correct distance from the outer mold wall to provide the required concrete cover and (2) providing a hand grip for grasping with one hand by a worker for the manual, tool-free installation of the weldless stirrup spacer on the reinforcement wires.

Figure 5A:
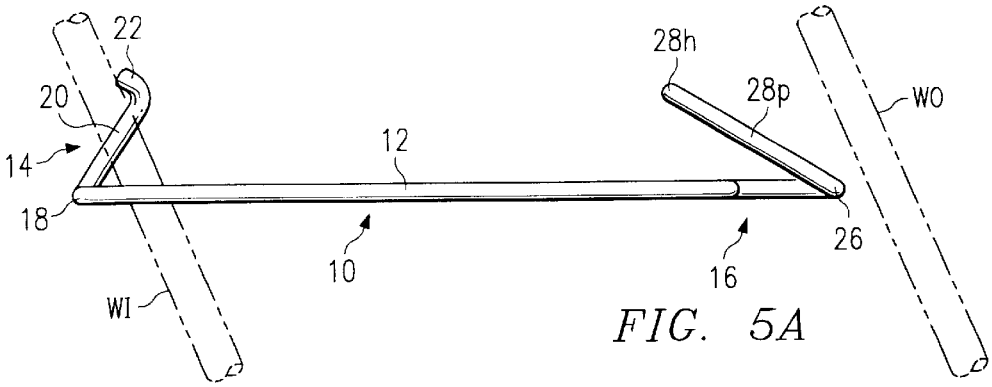
FIGS. 5A to 5D are top plan views, which show in sequence the positions of the weldless stirrup spacer at certain stages of installation to join two reinforcement cage wires.

The spacers 10 are installed in the following way:

FIG. 5A—The spacer is held by one hand by grasping the fastener-end spacer loop part 26. It is then inserted through an opening in the wire reinforcement of the outer cage and oriented obliquely and downwardly to a wire WI of the inner cage. The downward oblique orientation allows the hook end portion 14 to be looped under the wire WI by presenting the spiral axis A—A to the wire at an angle that leaves a space wide enough to accept the wire WI. The upright end portion 22 extends above the wire WI.

Figure 7B:
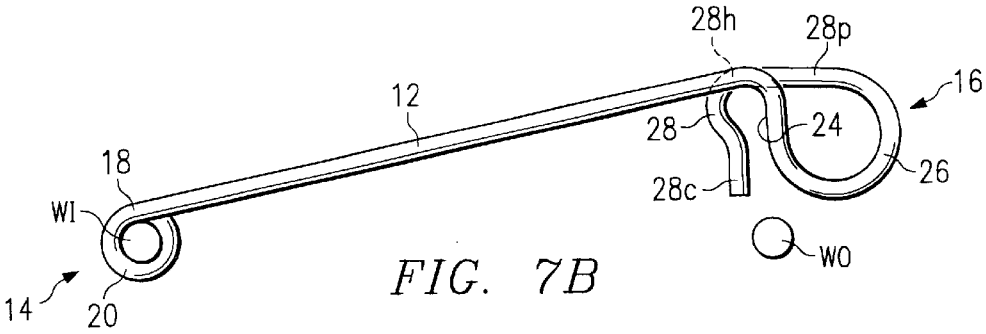
FIGS. 7B to 7D are front elevational views of the weldless stirrup spacer and the reinforcement cage wires at stages corresponding to those shown in FIGS. 5B to 5D.

FIGS. 5B and 7B—The spacer is rotated by hand about the hook end 14 in the direction of the arrow 30 towards a position in which the spanning portion 12 lies generally perpendicular to the inner wire WI and the outer wire WO, as shown in FIGS. 5B and 7B. Depending on the thickness of the wire WI, the spacer may actually lie somewhat oblique to the wires WI and WO (in either direction relative to the perpendicular position shown), but is engaged firmly on the inner wire WI by the four-way engagement described above. Further pivoting of the spacer in the direction of the arrow 30 requires applying a force to the fastening end portion 16. The fastening end portion 16 is above the wire WO at this stage (FIG. 7B), since the fastening end portion cannot be pushed down onto the wire WO when in the illustrated position of FIGS. 5B and 7B because the width of the throat T (FIG. 2) is narrower than the diameter of the wire WO.

Figure 5C:
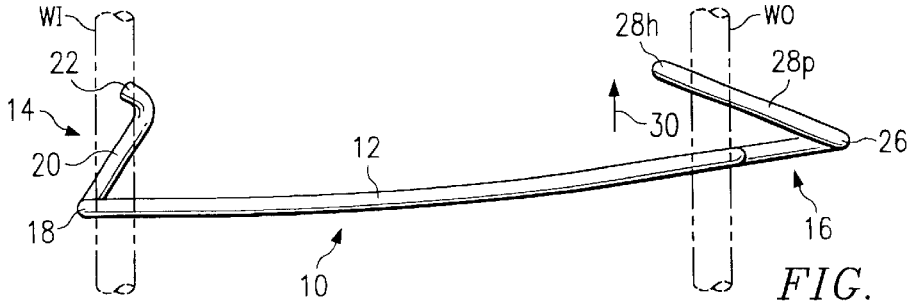
Figure 5D:
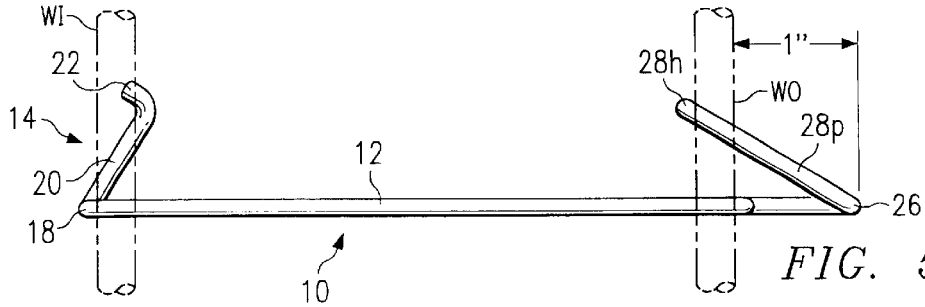
Figure 7C:
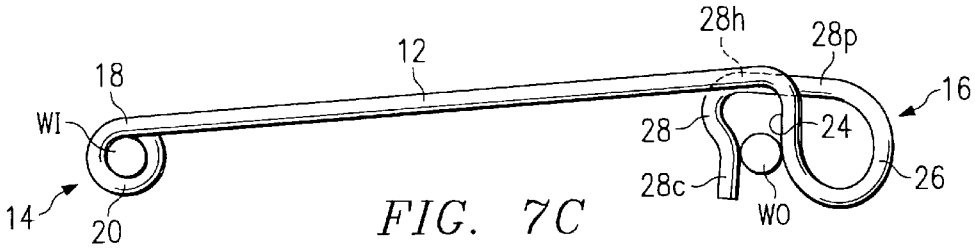
Figure 7D:
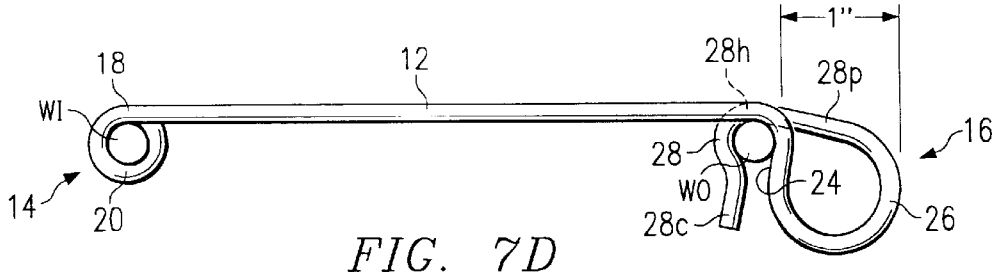

FIGS. 5C and 7C—The fastening end portion 16 is pushed by hand from the position shown in FIGS. 5B and 7B in the direction of the arrow 30, thus pivoting the spacer about the hook end portion 14 somewhat beyond a position in which the spanning portion lies perpendicular to the wires WI and WO. Inasmuch as the wire WI is tightly engaged with the hook end portion 14, the position in these figures is attained only by bending of the spanning portion 12 and stressing the pigtail hook end portion 14. When the spacer is in the position shown in FIGS. 5C and 7C, the fastening end 16 can be pushed down manually into place in engagement with the wire WO. The cam portion 28*c* of the J-hook part 28, working against the wire WO, forces the spacer loop part 26 of the fastening end portion 16 to constrict and, together with the favorable angling of the fastening end portion to the wire WO, such as to present a wider throat T in lateral profile (FIG. 7C) between the detent 24 and the J-hook 28 that enables the wire WO to be accepted into the detent 24 and the J-hook part 28.

FIGS. 5D and 7D—Because attaining the position shown in FIGS. 5C and 7C requires deformation of the spacer—a combination of bending of the spanning portion 12 and stressing of the pigtail portions 20 and 22 and constriction of the fastening end loop part 26—the spacer tends to restore itself by resiling to a position in which the spanning portion 12 is perpendicular to the wires WI and WO. Once the installed position is reached (FIGS. 5D and 7D), the residual pre-stresses in the pigtail portions 20 and 22 and the spacer loop portion 26 provide gripping forces between the pigtail portions 18, 20 and 22, at the end 14, and the fastening end portions 26 and 28, at the end 16, that frictionally hold the spacer in a lateral position. In the installed position of FIGS. 5D and 7D, the spacer loop 26 is somewhat constricted, relative to its relaxed (no load) state. Also, as may be observed in FIGS. 6 and 7D, the following engagements ensure that the spacer cannot release from either wire WI or WO and that the desired spacing between the wires is maintained:

Beginning at the juncture 18, the pigtail-shaped portion 20 of the hook end 14 engages upwardly, outwardly, downwardly and inwardly facing portions of the wire WI of the inner wire reinforcement cage (thereby resulting in four reactive forces S1, S2, S3 and S4, respectively, on the wire WI in the direction of the arrows in FIG. 6);

The detent part 24 of the fastening end portion 16 engages upwardly, outwardly and downwardly facing portions of the wire WO of the outer wire reinforcement cage;

The upright end part 22 of the hook end portion 14 engages upwardly and inwardly facing portions of the wire WI of the inner wire reinforcement cage (thereby resulting in reactive forces S1 and S4 on the wire WI); and The J-hook part 28 of the fastening end portion 16 engages upwardly, inwardly, and downwardly facing portions of the wire WO of the outer wire reinforcement cage.

Thus, the pigtail-shaped part 20 of the hook end portion 14 and the detent part 24 of the fastening end portion 16 keep the cage wires WI and WO from moving outwardly away from each other, and the hook part 20 and the fastening end portion 28 keep the cage wires from moving inwardly toward each other. The detent and hook parts of the fastening end portion 16 of the spacer, as viewed in elevation, present constricted throats, thus trapping the spacer against upward displacement away from the outer cage wire WO. Such detent and hook parts overlie the outer cage wire WO and, of course, cannot be dislodged in a downward direction. The pigtail end portions 20 and 22 fully encircle the inner cage wire WI and restrain it against dislodgement in any direction.

In most cases, the spacing between the outermost extremity of each cage reinforcement wire and the outermost extremity of the of the spacer loop portion 26 associated with the outer cage reinforcement wire WO will correspond to the specified concrete cover over the welded wire reinforcement, and the outermost extremity of the loop portion 26 will engage the outer form. The spacer is produced in a range of sizes to meet the specifications for the proper positioning and concrete cover of the wire reinforcement cages and their various gauges of wire and rebar for the precast concrete products and poured-in-place concrete structures in which they are to be used.

Although the present invention and its advantages have been described in detail, it should be understood that various changes, substitutions and alterations can be made in the embodiment described above without departing from the spirit and scope of the invention as defined by the following claims.

What is claimed is:

1. A weldless stirrup spacer for connecting a first reinforcement wire and a second reinforcement wire in spaced-apart relation, the spacer being a unitary resilient wire member comprising:

an elongated spanning portion, having an axis of elongation, adapted to extend between the first and second reinforcement wires;

a hook end portion at one end of the spanning portion;

a fastening end portion at the other end of the spanning portion;

the hook end portion having a generally spiral-shaped pigtail portion extending from a juncture with said one end of the spanning portion laterally to one side of the spanning portion along an axis of curvature for engaging, along said axis of curvature, upwardly, outwardly, downwardly and inwardly facing surfaces of the first reinforcement wire, said axis of curvature of the spiral-shaped pigtail portion being substantially perpendicular to the axis of elongation of the spanning portion, said spiral-shaped pigtail portion extending from said juncture over the upwardly facing surface of the first reinforcement wire, then downwardly around the outwardly facing surface of the first reinforcement wire, then under and around the downwardly facing surface of the first reinforcement wire, then upwardly around the inwardly facing surface of the first reinforcement wire, and terminating in a free-end portion over the upwardly facing surface of the first reinforcement wire; and the fastening end portion having (1) a detent part curved to form a groove at a juncture with the other end of the spanning portion so as to engage upwardly, outwardly and downwardly facing surfaces of the second reinforcement wire at a first location;

(2) a J-hook part shaped and positioned to form a groove so as to engage upwardly, inwardly and downwardly facing surfaces of the second wire at a second location along the second wire spaced apart laterally to said one side of the spanning portion from said first location; and (3) a loop part joining the detent part and the J-hook part.

2. The weldless stirrup spacer of claim 1, wherein the spiral-shaped pigtail portion comprises a curved body portion lying substantially in a plane that is inclined at an acute angle $\alpha$ to the axis of elongation of the spanning portion.

3. The weldless stirrup spacer of claim 2, wherein the free-end portion of the spiral-shaped pigtail portion extends out of the plane of said curved body portion in the direction away from said spanning portion.

4. The weldless stirrup spacer of claim 3, wherein said acute angle $\alpha$ is within the range of substantially $60°\pm5°$.

5. The weldless stirrup spacer of claim 4, wherein said free-end portion extends in a plane inclined at an angle of approximately $60°\pm5°$ to the axis of curvature of the pigtail portion.

6. The weldless stirrup spacer of claim 3, wherein said free-end portion terminates at substantially the same elevation as the spanning portion.

7. The weldless stirrup spacer according to claim 1, wherein the J-hook part of the fastening end portion includes a serpentine end leg part forming a camming surface adapted to engage an inner surface of the second wire and facilitate reception of the second reinforcement wire into the groove of the J-hook part.

8. The weldless stirrup spacer of claim 1, wherein when the spacer is installed on the wires the J-hook part and detent part of the fastening end portion form in profile a throat having an entrance that is narrower than the lateral thickness of the second reinforcement wire.

9. The weldless stirrup spacer of claim 1, wherein the loop part of the fastening end portion is substantially arcuate in profile.

10. The weldless stirrup spacer of claim 1, wherein the outermost extremity of the loop part of the fastening end is adapted to engage one form of a mold in which the concrete structure is made so as to position the reinforcement system in a predetermined position in the mold.

11. The weldless stirrup spacer of claim 10, wherein said loop part of the fastening end is adapted to function as a handgrip for facilitating the tool-less installation of the weldless stirrup spacer on the first and second reinforcement wires.

* * * * *